US010251466B2

(12) United States Patent
Soltez

(10) Patent No.: US 10,251,466 B2
(45) Date of Patent: Apr. 9, 2019

(54) BACKPACK WITH AUXILIARY HANDHOLDS

(71) Applicant: Nancy Soltez, Renton, WA (US)

(72) Inventor: Nancy Soltez, Renton, WA (US)

( * ) Notice: Subject to any disclaimer, the term of this patent is extended or adjusted under 35 U.S.C. 154(b) by 0 days.

(21) Appl. No.: 15/652,045

(22) Filed: Jul. 17, 2017

(65) Prior Publication Data

US 2019/0014887 A1 Jan. 17, 2019

(51) Int. Cl.
*A45F 3/04* (2006.01)
*A45F 3/00* (2006.01)

(52) U.S. Cl.
CPC ..... *A45F 3/047* (2013.01); *A45F 2003/001* (2013.01); *A45F 2003/045* (2013.01)

(58) Field of Classification Search
CPC ..... A45F 3/047; A45F 2003/001; A45F 2003/045
USPC ..... 224/627
See application file for complete search history.

(56) References Cited

U.S. PATENT DOCUMENTS 4,337,938 A * 7/1982 Rodriguez ..... A63B 69/0059 224/258
5,022,574 A * 6/1991 Cesari ..... A45C 5/14 190/127
5,498,218 A * 3/1996 Proctor ..... A63B 23/025 482/10
5,518,481 A * 5/1996 Darkwah ..... A63B 21/0004 482/126
5,529,556 A * 6/1996 Segarra ..... A63B 69/0028 224/259
5,971,244 A * 10/1999 Jaeger ..... A45F 3/08 224/632
6,190,340 B1 * 2/2001 Borell ..... A61F 5/3738 2/44
6,607,107 B2 * 8/2003 Dexheimer ..... A45F 3/04 224/262
7,232,048 B2 * 6/2007 Le Gal ..... A45F 3/04 224/201
9,295,318 B2 * 3/2016 Fischer ..... A45C 13/10
2002/0139821 A1 * 10/2002 Fleischli ..... B63C 9/087 224/153
2004/0178245 A1 * 9/2004 Le Gal ..... A45F 3/047 224/631
2005/0092803 A1 * 5/2005 Collier ..... A45C 7/0077 224/631

(Continued)

FOREIGN PATENT DOCUMENTS

EP 0060796 A1 * 9/1982 ..... A45F 3/04

*Primary Examiner* — Nathan J Newhouse
*Assistant Examiner* — Lester L Vanterpool
(74) *Attorney, Agent, or Firm* — Seed IP Law Group LLP

(57) ABSTRACT

A backpack is disclosed which includes a pack for accommodating a load, a pair of shoulder straps extending from the pack from which to haul the load, and an anti-fatigue arrangement including a respective auxiliary handhold at opposing ends thereof to provide the user with access to each auxiliary handhold at a respective location in front of each shoulder of the user. The auxiliary handholds enable a user to maintain his or her arms in an elevated position when using the backpack and to selectively manipulate the backpack on the upper back of the user. Methods of modifying a backpack having shoulder straps for carrying a load to include a pair of auxiliary handholds are also disclosed.

4 Claims, 5 Drawing Sheets

(56) References Cited

U.S. PATENT DOCUMENTS

| | | | | |
|---|---|---|---|---|
| 2005/0107222 | A1* | 5/2005 | Toven | A63B 69/0028<br>482/74 |
| 2010/0108731 | A1* | 5/2010 | Rowe | A45F 3/042<br>224/654 |
| 2014/0124560 | A1* | 5/2014 | Thatcher | A45F 3/14<br>224/600 |
| 2014/0353347 | A1* | 12/2014 | Fischer | A45C 13/10<br>224/148.4 |
| 2015/0290020 | A1* | 10/2015 | Carpenter | A61F 5/042<br>482/91 |
| 2017/0119133 | A1* | 5/2017 | Hopple | A45F 3/14 |

* cited by examiner

BACKPACK WITH AUXILIARY HANDHOLDS

BACKGROUND

Technical Field

This disclosure generally relates to backpacks and more specifically to providing a backpack with auxiliary handholds for a user to maintain his or her arms in an elevated position when using the backpack and to selectively manipulate the backpack on the upper back of the user.

Description of the Related Art

Backpacks come in a variety of styles and sizes and include various features for carrying a load when hiking or backpacking short or long distances, for example. One conventional backpack 10 that is particularly well suited for long distance backpacking is shown in FIG. 1. The backpack 10 includes a pack 12 with various compartments (e.g. an upper compartment and a lower compartment) for accommodating a load and a pair of shoulder straps 14R, 14L extending from the pack 12 from which to haul the load on a user's back. The backpack 10 further includes accessory loops 16R, 16L on the shoulder straps 14R, 14L for optionally securing one or more hiking or backpacking accessories to the straps, such as, for example, by using a carabiner to clip items to the accessory loops 16R, 16L. The backpack 10 also includes compression straps 18R, 18L spanning across opposing sides of the pack 12 for compressing the pack 12 around loaded items, and load adjuster straps 20R, 20L extending between the shoulder straps 14R, 14L and the pack 12 to enable a user to balance the load on his or her back. In addition, the backpack 10 includes a haul loop or pack handle 22 from which the backpack 10 may be conveniently lifted when putting on or taking off the backpack 10. Still further, the backpack 10 includes a sternum strap 24 to assist in holding the shoulder straps 14R, 14L in position on a user and an adjustable waist or hip belt 26 for securing a lower end of the backpack 10 around the user's waist or hips. The backpack 10 also includes other well-known backpack features and structures, which will be readily apparent to those of ordinary skill in the relevant art.

Although the conventional backpack 10 shown in FIG. 1 and other known backpacks are particularly well suited for long distance hiking or backpacking, among other activities, such backpacks nevertheless suffer from certain deficiencies and drawbacks. For example, during long distance hikes or backpacking, a user may experience swollen hands, uncomfortableness and fatigue resulting from carrying heavy packs in the same position over such long distances. Thus, applicant believes improvements in backpacks to address such discomfort and fatigue are desirable.

BRIEF SUMMARY

Embodiments of the backpacks disclosed herein and related methods of modifying or retrofitting backpacks to include a pair of auxiliary handholds are particularly well adapted for hauling a load over long distances with enhanced user comfort.

For example, one embodiment of a backpack may be summarized as including: a pack for accommodating a load; a pair of shoulder straps extending from the pack from which to haul the load; and an anti-fatigue arrangement including a respective auxiliary handhold at opposing ends thereof, which is configured to provide the user with access to each auxiliary handhold at a respective location in front of each shoulder of the user, the auxiliary handholds providing holds for the user to maintain his or her arms in an elevated position when using the backpack and to selectively manipulate the backpack on the upper back of the user.

In some instances, the anti-fatigue arrangement may comprise an elongate strap that forms a continuous flattened loop having an adjustable length, and the auxiliary handholds may be provided or defined at opposing ends of the continuous flattened loop. The backpack may further include one or more mounting structures located in a region corresponding to the upper back of a user, and the anti-fatigue arrangement may be removably coupled to the one or more mounting structures. In some instances, for example, the anti-fatigue arrangement may comprise an elongate strap that passes through the one or more mounting structures or that wraps around at least a portion of the one or more mounting structures. The mounting structures may include, for example, one or more portions of a compression strap, a shoulder strap, a load adjuster strap and/or a central haul loop.

In some instances, the anti-fatigue arrangement may comprise a strap having a right-side strap portion that extends from a right side of the backpack and a left-side strap portion that extends from a right side of the backpack. In addition, the backpack may further include a right-side accessory loop on an exterior of a right one of the shoulder straps and a left-side accessory loop on an exterior of a left one of the shoulder straps, and one of the opposing ends of the anti-fatigue arrangement may pass through the right-side accessory loop while the other end may pass through the left-side accessory loop.

The backpack may further include at least one compression strap extending across the right side of the backpack and having a base end proximate a back-receiving portion of the pack and at least one compression strap extending across the left side of the backpack and having a base end proximate the back-receiving portion of the pack, and the anti-fatigue arrangement may be secured to the pack via the compression straps (e.g., tied to, clipped to, fastened to, wrapped around, or passed through).

In some instances, the anti-fatigue arrangement may be threaded through loop structures on the pack and/or the shoulder straps to fasten or secure the anti-fatigue arrangement to the pack. For example, in some instance, the backpack may include a central haul loop and the anti-fatigue arrangement may be wrapped around the central haul loop (e.g., tied to the central haul loop) to secure the anti-fatigue arrangement to the pack. In other instances, the anti-fatigue arrangement may be passed through or wrapped around shoulder straps, compression straps, load adjuster straps and/or adjacent structures thereto.

According to another embodiment, a method of modifying a backpack having shoulder straps for carrying a load to include a pair of auxiliary handholds may be summarized as including: identifying one or more mounting structures on the backpack in a region corresponding to the upper back of a user; and securing a backpack accessory comprising the auxiliary handholds to the one or more mounting structures to provide the user with access to each auxiliary handhold at a respective location in front of each shoulder of the user, the auxiliary handholds providing holds for the user to maintain his or her arms in an elevated position when using the backpack and to selectively manipulate the backpack on the upper back of the user.

In some instances, the backpack accessory may comprise an elongate strap and securing the backpack accessory to the one or more mounting structures of the backpack may include inserting the elongate strap through the one or more mounting structures or wrapping the elongate strap around at least a portion of the one or more mounting structures. The mounting structures on the backpack may comprise, for example, a portion of a compression strap of the backpack, a portion of a shoulder strap of the backpack, a portion of a load adjuster strap of the backpack, a central haul loop of the backpack, and/or adjacent structures thereto.

In some instances, the backpack accessory may comprise an elongate strap, the one or more mounting structures may include a respective mount on each of opposing sides of a midline of the user, and securing the backpack accessory to the one or more mounting structures of the backpack may include passing the elongate strap through or wrapping the elongate strap around each mount such that a right-side strap portion and one of the auxiliary handholds extends from a right side of the user and a left-side strap portion and one of the auxiliary handholds extends from a left side of the user. The method may further include: passing one of the opposing ends of the backpack accessory through a right-side accessory loop on an exterior side of a right one of the shoulder straps of the backpack, and passing the other one of the opposing ends of the backpack accessory through a left-side accessory loop on an exterior side of a left one of the shoulder straps of the backpack.

DETAILED DESCRIPTION

In the following description, certain specific details are set forth in order to provide a thorough understanding of various disclosed embodiments. However, one skilled in the relevant art will recognize that embodiments may be practiced without one or more of these specific details. In other instances, well-known structures and techniques associated with backpacks as well as methods of making or using the same may not be shown or described in detail to avoid unnecessarily obscuring descriptions of the embodiments.

Unless the context requires otherwise, throughout the specification and claims which follow, the word "comprise" and variations thereof, such as, "comprises" and "comprising" are to be construed in an open, inclusive sense, that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

Figure 1:
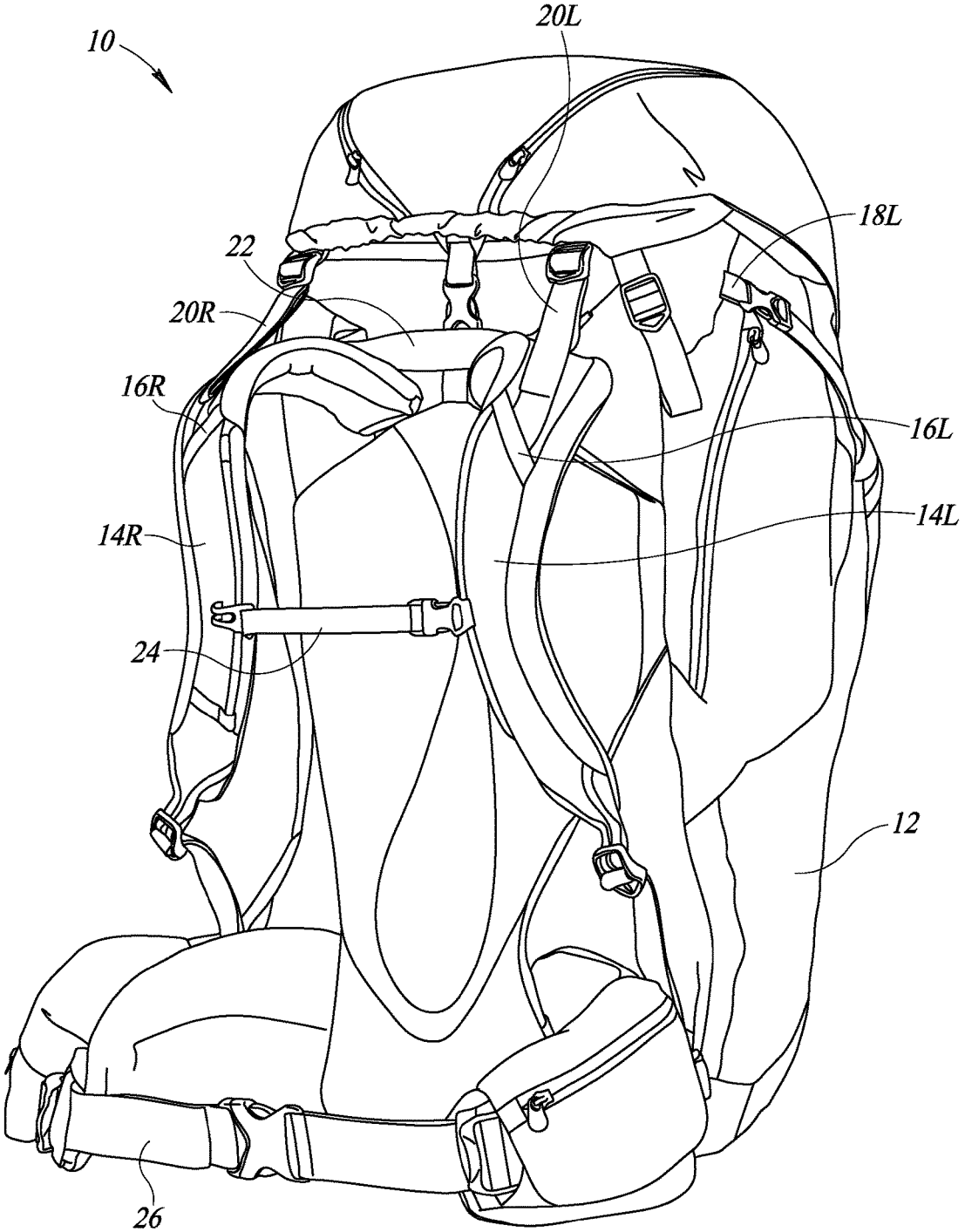
FIG. 1 (PRIOR ART)
FIG. 1 is a perspective view of a conventional backpack.
Figure 2:
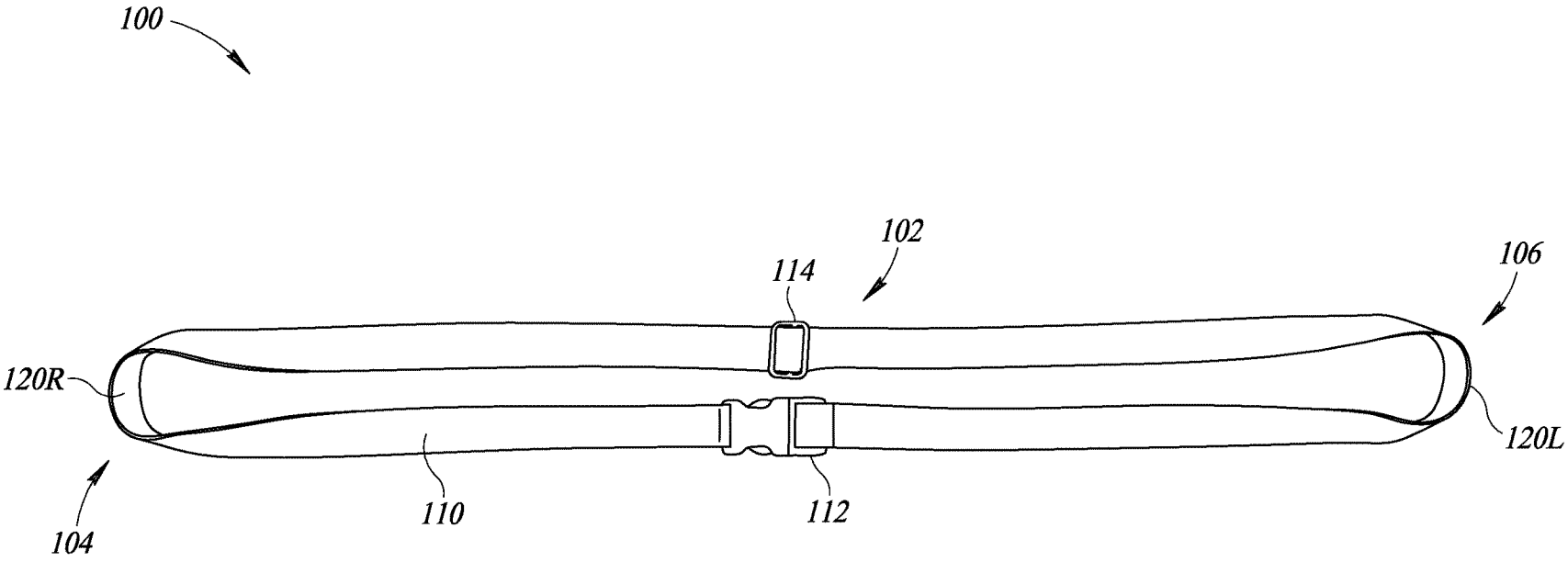
FIG. 2 is a top plan view of a backpack accessory (also referred to as an anti-fatigue arrangement), according to an example embodiment of the present invention.
Figure 3:
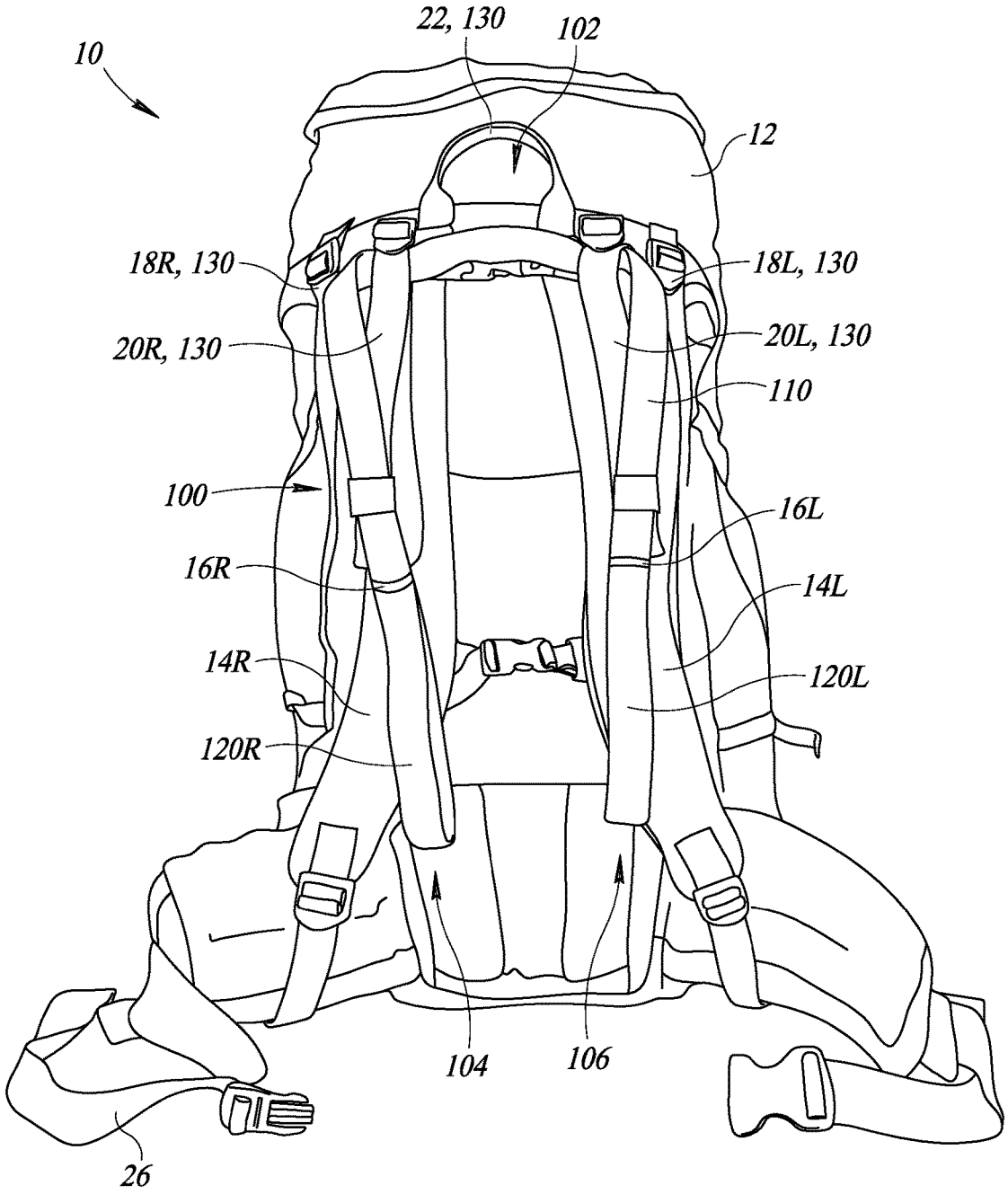
FIG. 3 is a front elevational view of a backpack modified to include an anti-fatigue arrangement according to an example embodiment of the present invention.

FIG. 1 shows a conventional backpack 10. FIG. 2 shows an example embodiment of a backpack accessory in the form of an anti-fatigue arrangement 100, which may be used to modify a conventional backpack, such as the conventional backpack 10 of FIG. 1, to include auxiliary handholds. FIG. 3 is a front elevational view of a backpack 10 modified to include an anti-fatigue arrangement 100, according to an example embodiment of the present invention, and FIGS. 4 and 5 provide views of the backpack 10 and anti-fatigue arrangement 100 in use on the back of a user.

With reference to FIG. 1, the backpack 10 includes a pack 12 with compartments for accommodating a load and a pair of shoulder straps 14R, 14L extending from the pack 12 from which to haul the load on a user's back. The backpack 10 further includes accessory loops 16R, 16L on the shoulder straps 14R, 14L for optionally securing one or more hiking or backpacking accessories to the shoulder straps 14R, 14L. The backpack 10 also includes compression straps 18R, 18L spanning across opposing sides of the pack 12 for compressing the pack 12 around loaded items, and load adjuster straps 20R, 20L extending between the shoulder straps 14R, 14L and the pack 12 to enable a user to balance the load on his or her back. In addition, the backpack 10 includes a haul loop or pack handle 22 from which the backpack 10 may be conveniently lifted when putting on or taking off the backpack 10. Still further, the backpack 10 includes a sternum strap 24 to assist in holding the shoulder straps 14R, 14L in position on a user and an adjustable waist or hip belt 26 for securing a lower end of the backpack 10 around the user's waist or hips. The backpack 10 also includes other well-known backpack features and structures, which will be readily apparent to those of ordinary skill in the relevant art.

With reference to FIG. 2, an example embodiment of a backpack accessory in the form of an anti-fatigue arrangement 100 is shown, which may be used to modify a conventional backpack, such as the conventional backpack 10 of FIG. 1, to include auxiliary handholds 120R, 120L. According to the example embodiment, the anti-fatigue arrangement 100 may be provided in the form of an elongate strap 110 that forms a continuous flattened loop having an adjustable length, and wherein auxiliary handholds 120R, 120L are defined at opposing ends 104, 106 of the continuous flattened loop. To provide adjustability and flexibility, the strap 110 may include a release buckle 112 and a strap adjuster 114. In this manner, a user may unbuckle the strap 110 to assist in installing or removing the anti-fatigue arrangement 100 from the backpack 10. In addition, a user can adjust a length of the strap 110 by using the strap adjuster 114 to reposition the handholds 120R, 120L to suit the preferences of the user.

Figure 4:
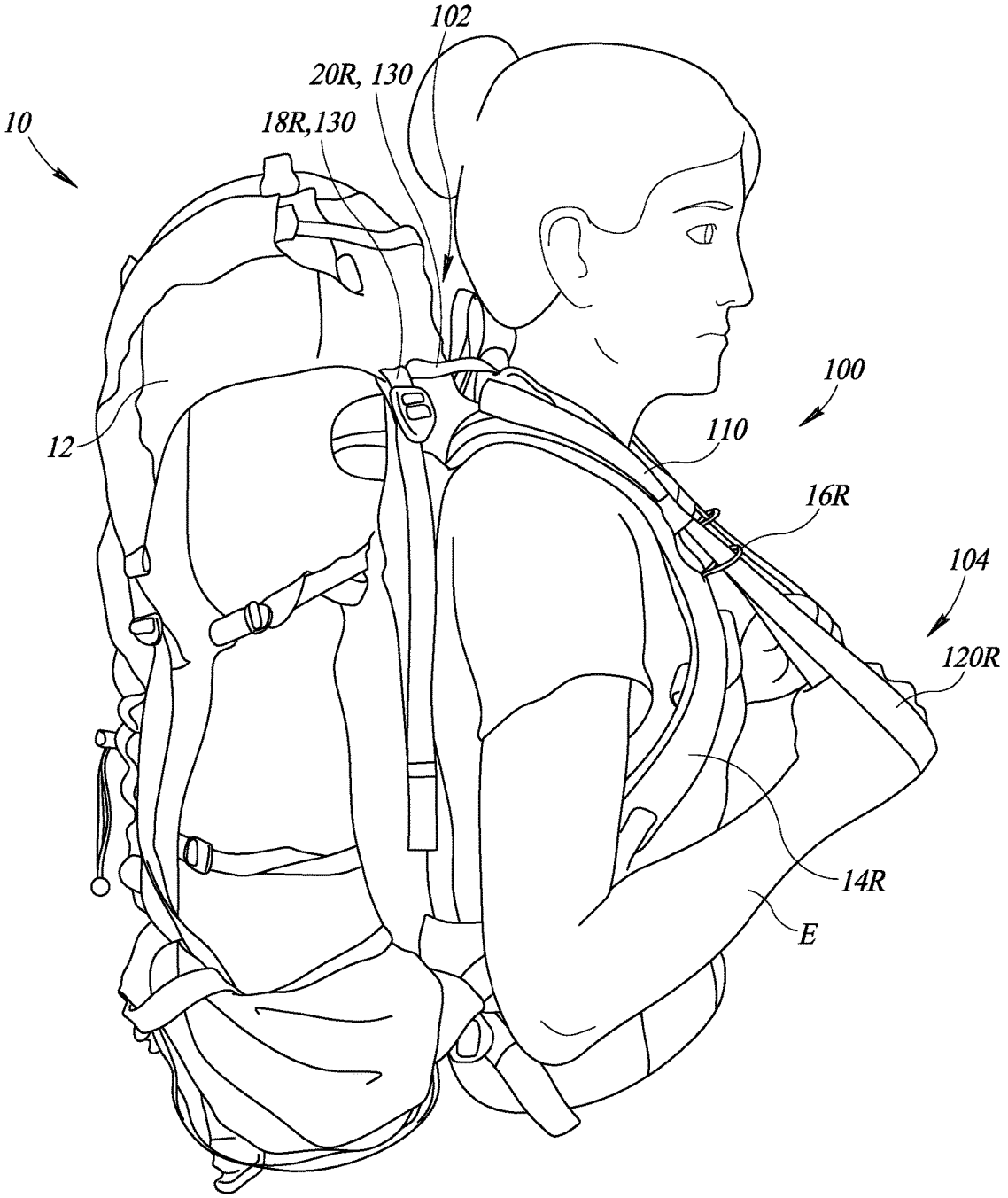
FIG. 4 is a side elevational view of the modified backpack of FIG. 3 shown in use on the back of a user.
Figure 5:
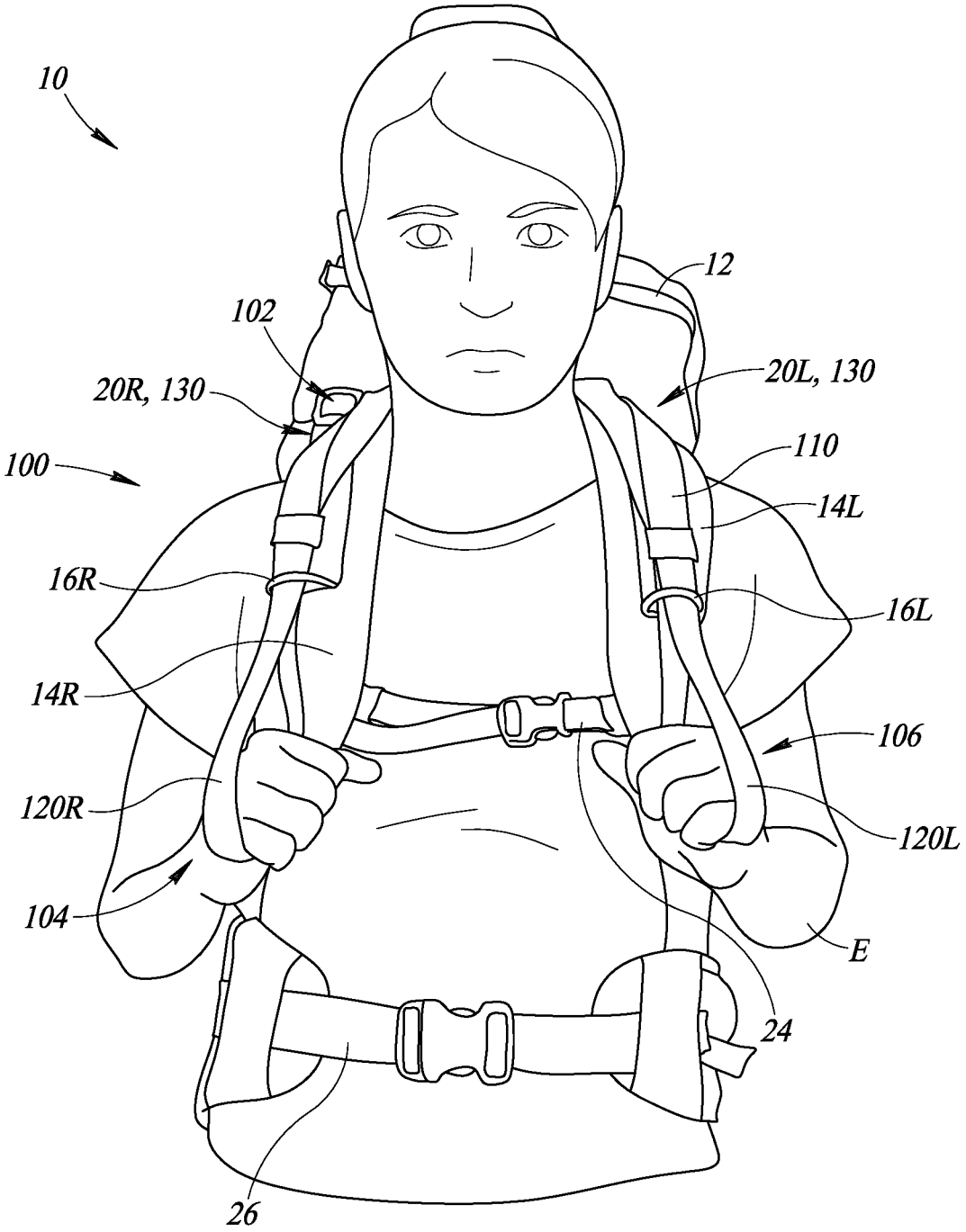
FIG. 5 is a front elevational view of the modified backpack of FIG. 3 shown in use on the back of a user.

With reference to FIGS. 3 through 5, the anti-fatigue arrangement 100 may include a central portion 102 between opposing ends 104, 106 and each auxiliary handhold 120R, 120L may be provided at a respective one of the opposing ends 104, 106. The auxiliary handholds 120R, 120L may be integrally formed at opposing ends of a common structure. In other instances, separate handholds (e.g., handles, grips)

may be attached to opposing ends 104, 106 of the anti-fatigue arrangement 100 with fasteners or other attachment devices or techniques. In some instances, each auxiliary handhold 120R, 120L may comprise a fixed loop structure. The anti-fatigue arrangement 100 is configured such that, upon attachment to the backpack 10, each auxiliary handhold 120R, 120L is positioned at a respective location in front of each shoulder of the user to enable the user to maintain his or her arms in an elevated position E (FIGS. 4 and 5) when using the backpack 10 and to selectively manipulate the backpack 10 on the upper back of the user by pulling on the handholds 120R, 120L.

With continued reference to FIGS. 3 through 5, it is appreciated that a method of modifying a backpack 10 having shoulder straps 14 for carrying a load to include a pair of auxiliary handholds 120R, 120L may be provided, which includes: identifying one or more mounting structures 130 on the backpack 10 in a region corresponding to the upper back of a user; and securing a backpack accessory (e.g., anti-fatigue arrangement 100) to the one or more mounting structures 130 such that auxiliary handholds 120R, 120L are accessible at a respective location in front of each shoulder of the user to enable the user to maintain his or her arms in an elevated position E when using the backpack 10, and to selectively manipulate the backpack 10 on the upper back of the user, if desired. The one or more mounting structures 130 on the backpack 10 may include, but are not limited to: a portion of a compression strap 18R, 18L of the backpack 10; a portion of one of the shoulder straps 14 of the backpack 10; a portion of a load adjuster strap 20R, 20L of the backpack 10; a central haul loop 22 of the backpack 10; and/or adjacent structures thereto. Securing the backpack accessory (e.g., anti-fatigue arrangement 100) to the one or more mounting structures 130 may include, for example, inserting the elongate strap 110 through the one or more mounting structures 130 or wrapping the elongate strap 110 around at least a portion of the one or more mounting structures 130.

For example, in some instances, the backpack accessory (e.g., anti-fatigue arrangement 100) may be secured to the backpack 10 by inserting the elongate strap 110 through or wrapping the strap around a portion of a compression strap 18R, 18L on each of opposing sides of the backpack 10. In other instances, the backpack accessory (e.g., anti-fatigue arrangement 100) may be secured to the backpack 10 by inserting the elongate strap 110 through or wrapping the strap around a portion of each shoulder strap 14. In still other instances, the backpack accessory (e.g., anti-fatigue arrangement 100) may be secured to the backpack 10 by inserting the elongate strap 110 through or wrapping the strap around a portion of each load adjuster strap 14. In still yet other instances, the backpack accessory (e.g., anti-fatigue arrangement 100) may be secured to the backpack 10 by inserting the elongate strap 110 through or wrapping the strap around a central haul loop 22 of the backpack 10. Inserting the elongate strap 110 through or wrapping the strap 110 around such structures may include tying the strap 110 to such structures using conventional knots. In other instances, the strap 110 may be provided with one or more fastening devices (e.g., clips, snaps, clasps) for attaching the anti-fatigue arrangement 100 to the backpack 10. Irrespective of the particular attachment device technique, the anti-fatigue arrangement 100 may be removably coupled to the backpack 10 to facilitate selectively attaching the anti-fatigue arrangement 100 to the backpack 10 and removing the anti-fatigue arrangement 100 from the backpack 10. In this manner, the anti-fatigue arrangement 100 may be conveniently removed for cleaning purposes, or may be replaced when excessively worn or damaged without requiring replacement of the backpack 10, or may be removed for use with another backpack 10. Accordingly, the anti-fatigue arrangement 100 may provide a particularly versatile device for fighting user discomfort and fatigue on long treks.

In one particularly advantageous aspect, the anti-fatigue arrangement 100 may be secured to the backpack 10 by passing it through or wrapping it around a respective mount 130 on each of opposing sides of a midline of the user such that a right-side strap portion and one of the auxiliary handholds 120R extends from a mount on a right side of the user and a left-side strap portion and one of the auxiliary handholds 120L extends from a mount on a left side of the user. Securing the anti-fatigue arrangement 100 to the backpack 10 may also include passing one of the opposing ends 104 of the anti-fatigue arrangement 100 through a right-side accessory loop 16R on an exterior side of a right one of the shoulder straps 14R of the backpack 10, and passing the other end 106 through a left-side accessory loop 16L on an exterior side of a left one of the shoulder straps 14L of the backpack 10. Doing so may keep the auxiliary handholds 120R, 120L close to the user's chest when not in use and in locations that are readily accessible to the user.

Although embodiments disclosed herein are described in the context of modifying conventional backpacks to include auxiliary handholds, such as, for example, by retrofitting a backpack to include such auxiliary handholds. It is appreciated that backpacks may be manufactured to include embodiments of the anti-fatigue arrangements 100 described herein or similar structures. In addition, although particularly advantageous embodiments are disclosed herein as providing a pair of auxiliary handholds via a single anti-fatigue arrangement 100, it is appreciated that in alternative embodiments, each auxiliary handhold may be provided by a separate handhold unit that is separately removably coupleable to a conventional backpack to enhance functionality of the backpack.

Moreover, it is appreciated that aspects and features of the various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A method of using a backpack accessory to: (i) modify a backpack having a pack and shoulder straps for carrying a load to include a pair of auxiliary handholds, (ii) selectively rest a user's arms while hiking, and (iii) selectively adjust the pack on the user's back while hiking, the method including:

identifying one or more mounting structures on the backpack remote from the shoulder straps and in a region corresponding to the upper back of the user, the one or more mounting structures comprising at least one of a compression strap, a load adjuster strap or a central haul loop of the backpack;

removably securing the backpack accessory to the one or more mounting structures, which are remote from the shoulder straps, the backpack accessory comprising a central portion between opposing ends with each auxiliary handhold being provided at a respective one of the opposing ends;

arranging the backpack accessory to provide the user with access to each auxiliary handhold at a respective location in front of each shoulder of the user;

selectively maintaining the user's arms in an elevated position when using the backpack while the load in the pack is carried via the shoulder straps; and selectively manipulating the pack of the backpack on the upper back of the user via the backpack accessory without directly pulling on the shoulder straps.

2. The method of claim 1 wherein the backpack accessory comprises an elongate strap that forms a continuous flattened loop having an adjustable length, and the auxiliary handholds are defined at opposing ends of the continuous flattened loop.

3. The method of claim 1 wherein the backpack accessory comprises an elongate strap and removably securing the backpack accessory to the one or more mounting structures of the backpack includes inserting the elongate strap through the one or more mounting structures or wrapping the elongate strap around at least a portion of the one or more mounting structures.

4. The method of claim 1 wherein:

the backpack accessory comprises an elongate strap;

the one or more mounting structures include a respective mount on each of opposing sides of a midline of the user; and removably securing the backpack accessory to the one or more mounting structures of the backpack includes passing the elongate strap through or wrapping the elongate strap around each mount such that a right-side strap portion and one of the auxiliary handholds extends from a right side of the user and a left-side strap portion and one of the auxiliary handholds extends from a left side of the user.

* * * * *